US005290413A

United States Patent [19]

Bauer et al.

[11] Patent Number: 5,290,413

[45] Date of Patent: Mar. 1, 1994

[54] ANODIC ELECTRODE FOR ELECTROCHEMICAL FLUORINE CELL

[75] Inventors: Gerald L. Bauer, Hudson, Wis.; William V. Childs, Stillwater, Minn.; Charles F. Kolpin, River Falls, Wis.; Dean T. Rutten, White Bear Lake, Minn.

[73] Assignee: Minnesota Mining and Manufacturing Company, St. Paul, Minn.

[21] Appl. No.: 990,368

[22] Filed: Dec. 15, 1992

Related U.S. Application Data

[63] Continuation of Ser. No. 736,227, Jul. 26, 1991, abandoned.

[51] Int. Cl.[5] ..... C25B 11/02

[52] U.S. Cl. ..... 204/243 R; 204/278; 204/280; 204/286; 204/290 R; 204/294

[56] References Cited

U.S. PATENT DOCUMENTS

| | | | |
|---|---|---|---|
| 2,273,798 | 2/1942 | Heise | 204/82 |
| 3,041,266 | 6/1962 | Cable et al. | 204/288 |
| 3,069,345 | 12/1962 | Lowdermilk et al. | 204/286 |
| 3,212,930 | 10/1965 | Thompson et al. | 117/213 |
| 3,395,049 | 7/1968 | Thompson | 136/122 |
| 3,655,535 | 4/1972 | Ruehlen | 204/59 |
| 3,676,324 | 7/1972 | Mills | 204/284 |
| 3,708,416 | 1/1973 | Ruehlen et al. | 204/284 |
| 3,720,597 | 3/1973 | Ashe, Jr. et al. | 204/284 |
| 3,772,201 | 11/1973 | Mills | 204/246 |
| 3,773,644 | 11/1973 | Tricoli | 204/252 |
| 4,139,447 | 2/1979 | Faron et al. | 204/239 |
| 4,312,718 | 1/1982 | Watanabe et al. | 204/60 |
| 4,474,613 | 10/1984 | Zöllner | 204/286 |
| 4,491,653 | 1/1985 | McGinniss et al. | 525/356 |
| 4,511,440 | 4/1985 | Saprokhin | 204/60 |
| 4,602,985 | 7/1986 | Hough et al. | 204/60 |
| 4,640,744 | 2/1987 | Howe | 204/1 |
| 4,915,809 | 4/1990 | Brown et al. | 204/243 |
| 4,950,370 | 8/1990 | Tarancon | 204/128 |

FOREIGN PATENT DOCUMENTS

| | | |
|---|---|---|
| 60-221591 | 11/1985 | Japan . |
| WO90/06296 | 6/1990 | PCT Int'l Appl. . |
| 2135334A | 8/1984 | United Kingdom . |
| 2135335A | 8/1984 | United Kingdom . |

OTHER PUBLICATIONS

Techniques of Chemistry, "Technique of Electroorganic Synthesis," The Phillips Electrochemical Fluorination Proc., Chap. 7, pp. 341-381 (John Wiley & Sons, (1982).

Rudge, "The Manufacture and Use of Fluorine and Its Compounds," pp. 18-45, 82-83, Oxford University Press (1962).

Childs et al., "Anodic Fluorination," Chapter 26 (pp. 1103-1127) of "Organic Electrochemistry: An Introduction and a Guide," 3rd ed. Marcell Dekker, Inc., 1991.

Schonhorn et al., "Surface Treatment of Polymers. II. Effectiveness of Fluorination as a Surface Treatment of Polyethylene," J. of Appl Polym Sci., vol. 12, pp. 1231-1237 (1968).

*Primary Examiner*—Kathryn Gorgos

*Attorney, Agent, or Firm*—Gary L. Griswold; Walter N. Kirn; Carolyn V. Peters

[57] ABSTRACT

Carbon electrodes for use as an anode in electrochemical cells for the generation of fluorine by electrolysis of molten KF.2HF electrolyte. Also included is a process for the operation of an electrochemical fluorine cell in combination with a direct fluorination reactor.

8 Claims, 5 Drawing Sheets

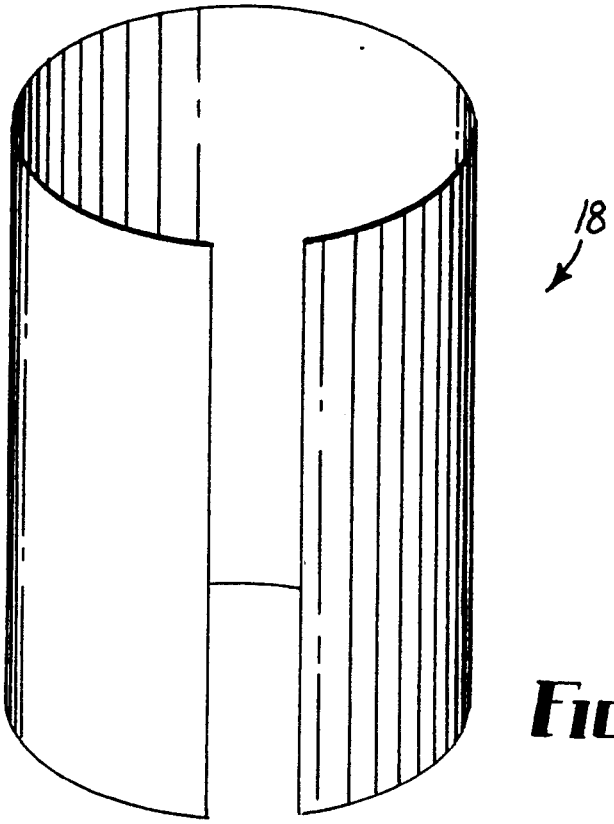
Fig. 2
Fig. 3
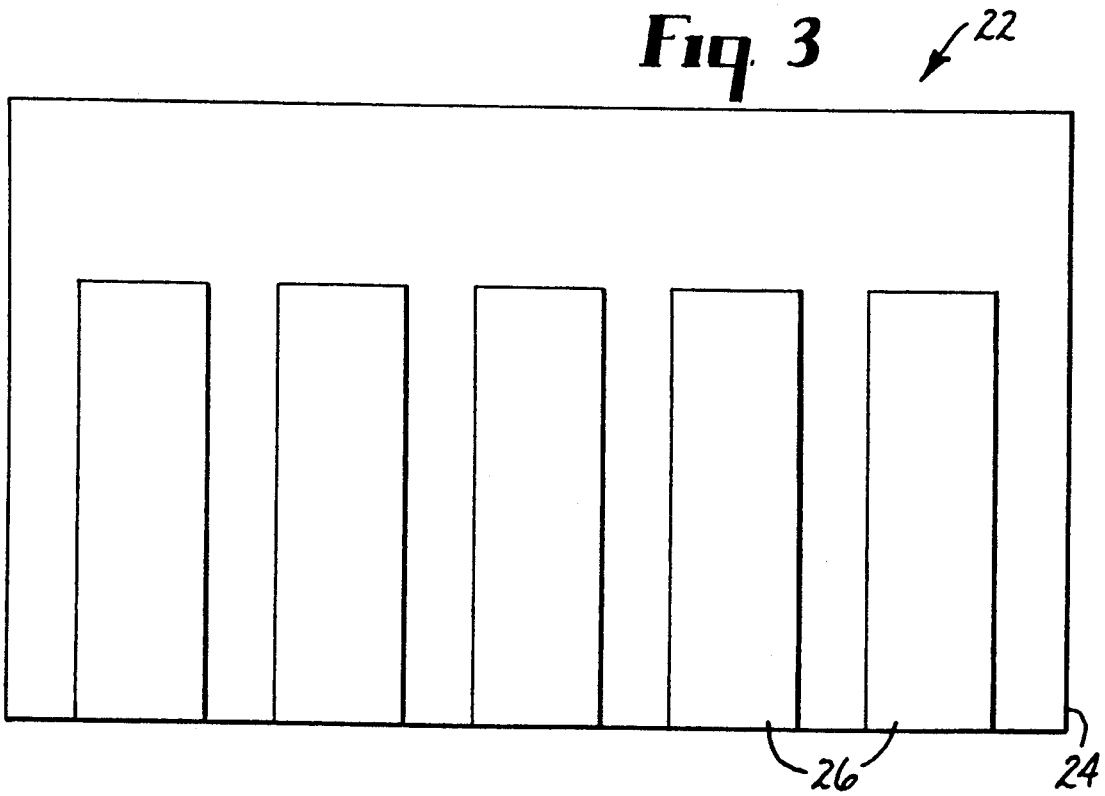

ANODIC ELECTRODE FOR ELECTROCHEMICAL FLUORINE CELL

This is a continuation of Application Ser. No. 07/736,227 filed Jul. 26, 1991, now abandoned.

TECHNICAL FIELD

This invention relates to carbon electrodes for use as anodes in electrochemical cells for the generation of fluorine by electrolysis of a fused potassium fluoride-hydrogen fluoride electrolyte. In another aspect, the invention relates to an electrochemical fluorine cell. In a further aspect, this invention relates to a process for the operation of an electrochemical fluorine cell and a fluorination reactor.

BACKGROUND OF THE INVENTION

In the electrolytic production of fluorine gas (used, for example, in the fluorination of organic substances), commonly used commercial cells comprise an electrolyte-resistant container, a cathode, an electrolyte, a gas separation means, and an anode. The electrolyte-resistant container further comprises a means to maintain electrolyte temperature and a means to replenish hydrogen fluoride consumed during the generation process. The cathode is typically composed of ordinary mild steel, nickel, or MONEL nickel alloy. The electrolyte is typically an approximate composition of KF.2HF and contains approximately 39 to 42% hydrogen fluoride. See Rudge, *The Manufacture and Use of Fluorine and Its Compounds*, 18–45, 82–83 Oxford University Press (1962). A gas separation means keeps the generated hydrogen (formed at the cathode) and the generated fluorine (formed at the anode) from spontaneously, and often violently, reforming hydrogen fluoride, see U.S. Pat. No. 4,602,985 (Hough).

The anode used in the electrochemical fluorine cell is typically made of ungraphitized carbon. The carbon can be low-permeability, or high-permeability, monolithic structure, or a composite structure. In a composite structure, there is an inner core of low-permeability carbon and an outer shell of high-permeability carbon formed onto the inner core (see UK Patent Application 2 135 335 A (Marshall)) or otherwise assembled or fabricated (see U.S. Pat. Nos. 3,655,535 (Ruehlen et al.), 3,676,324 (Mills), 3,708,416 (Ruehlen et al.), and 3,720,597 (Ashe et al.)).

The configuration of the electrode and the characteristics of the materials used therefor determine the efficiency and life of the electrode. Carbon electrodes commonly used as anodes in electrolytic cells are generally a shaped mass of compressed carbon. Typically, commercial anodes have approximately planar or flat surface.

According to Rudge, supra, fluorine generated from a salt melt, such as KF.2HF, is well known. However, the nature of the electrolytic process is still largely unexplained, although it is known that conditions that exist at or near the surface of the anode are influential on the performance of the anode, see Rudge, supra. When a carbon electrode is immersed into the electrolyte, the carbon is "wetted" by the electrolyte. However, when the electrode is made anodic with reference to another electrode, the carbon is no longer "wetted" by the liquid electrolyte, that is, the "contact angle" increases from about zero to well above 90°. The term "wetted" as used in this application means the spreading of a liquid as a continuous film on a solid, such that the contact angle approaches zero. The term "contact angle" as used in this application means the angle that the surface of a liquid makes with the surface of a solid. Fluorine bubbles at the surface of the anode are lenticularly-shaped and adhere to the surface of the anode.

The forces that lead to poor wetting of the carbon anode by the electrolyte make it difficult for the electrolyte to enter any pores in the anode that may be present until there is sufficient hydrostatic pressure to force it into the pores, see Rudge, supra. For example, carbon that is often used as an anode has a permeability in the range of 0.3 to 3 $m^3air \cdot m^{-2}min$ (1.0 to 10 $ft^3air \cdot ft^{-2}min$) through a 2.54 cm (1 inch) thick plate at $5.0 \times 10^2$ pascals (Pa) (0° C. and 760 mm Hg of pressure) having internal void volumes of up to 50% or more of the overall volume of the carbon. In the carbon anode, the generated fluorine leaves the anodic surface where it is generated, passes into a reticulated network of pores, passes up through this network, and passes from this network near or above the electrolyte level into the fluorine collection space. It might appear that at significant depths the electrolyte that is forced into the pores by hydrostatic pressure would prevent the fluorine from entering the pores. However, since the electrolyte only poorly wets the carbon, the fluorine gas generated at the surface of the anode has enough energy to displace the electrolyte and enter the reticulated network of pores, as noted above. The electrical resistance of highly porous carbons may be four times that of dense carbon described below. This leads to poorer current density distribution.

According to Rudge, supra, if the carbon anode is fabricated from impervious carbon, that is, low-permeability carbon, the anode also tends to be wetted poorly by the electrolyte. Since there is no appreciable internal reticulated network of pores to escape through, the fluorine gas generated at the surface forms lenticular bubbles on the surface of the anode. As more current is passed through the anode, the bubbles grow and hydrostatic forces force them upward along the anodic surface until they pass into a fluorine collection volume, above the electrolyte surface. As a result, a very large fraction of the anodic surface may be masked by these lenticularly-shaped bubbles. This leads to a reduction of the surface area available to pass electrolytic current into the electrolyte from the anode and generally requires higher voltage operation to obtain the same amount of current. The electrical resistance of low-permeability carbon is only a fraction of that of high-permeability carbon leading to an improved current distribution within the body of the anode.

As discussed in Rudge, supra, "polarization" appears to be a problem associated with low-permeability carbon anodes, and to a lesser extent with high-permeability carbon anodes. High-permeability carbon electrodes tend to have a higher threshold to polarization. However, they are intrinsically a poorer conductor than low-permeability carbon, thus high-permeability carbon tends to display a poor current distribution profile. Under constant current operation, the cell voltage will increase, gradually at first and then rapidly until essentially no current will pass through the anode, even at twice the normal voltage. When this happens, the anode is said to be polarized. High voltage treatment is known to provide relief. Various additives and treatments also have been offered to prevent the onset of polarization. For example, see U.S. Pat. No. 4,602,985 (Hough) that describes a carbon cell electrode with improved cell efficiency having smooth, polished surfaces. A method of polishing is also described.

Rudge, supra, further states that in addition to the problems of recovery of the generated fluorine and polarization of the carbon anode, there are several other problems that have been recognized. They include (1) electrical connection between the carbon anode and the current carrying metal contacts, (2) corrosion of the metal at the metal-carbon joint of the electrode, (3) mechanical failure of the carbon anode under uneven mechanical stress; and (4) current distribution up and down the anode.

As noted in Rudge, supra, the first two problems are closely related and should be considered when providing an electrode that will be suspended in an electrolyte. The mechanical and electrical connection between the metal of the current carrying contacts and the carbon anode is subjected to at least two major failure modes. The first failure situation is the mechanical and electrical ability to provide a sound electrical connection. The second failure situation is "bimetallic" or galvanic corrosion at the metal-carbon joint. The area of the carbon anode between the upper surface of the electrolyte and the metal interface of a current collector is subject to resistive heating. This metal-carbon joint corrosion as noted in U.S. Pat. No. 3,773,644 (Tricoli et al.) tends to worsen with the passage of time. During the operation of a cell, high electrical resistance products form at the metal-carbon joint. This is most likely due to vapors developed in the anodic zone above the electrolyte surface and seepage of electrolyte into the metal-carbon joint. These deposits tend to accelerate overheating. Additionally, this leads to accelerated corrosion, accumulations of corrosion products, and the cyclic problem of increased resistive heating due to still higher resistance in the joint.

U.S. Pat. No. 3,773,644 (Tricoli et al.) describes an improved electrolytic cell that is provided with carbon anodes protruding from the cell. The section protruding from the cell is covered by a gas-proof coat made of a good conducting material. The coat is described as consisting of a cap coupled by forcing onto the anode and snugly fitting over and upon the end of the anode.

An electrode is described in UK 2 135 334 A (Marshall) wherein a nickel plate is welded to a threaded rod that is screwed into a hole in the top of a carbon anode. The outer part of the electrode is then sprayed with a molten nickel. This provides conductive continuity between the inner and outer cores of the electrode.

In Japanese Kokai Application 60221591 (Kobayashi et al.) (English translation), an electrode is described wherein copper or nickel are flame fusion coated on the contacting surface of the carbon electrode. A number of metals, such as brass, gold, tin, aluminum, silver, iron, stainless steel are also disclosed.

SUMMARY OF THE INVENTION

Briefly, in one aspect of the present invention, an electrode is provided, which is useful as an anode in an electrochemical cell for the electrolytic generation or production of fluorine gas from molten KF.2HF electrolyte. In this application "anode" means the electrochemically-active portion of the electrode where fluorine is generated in the cell when current is applied to the electrode. The electrode comprises a current carrier, a current collector, and an anode comprising nongraphitic carbon and is used to generate fluorine at the anodic surface of the carbon. The current carrier comprises a metal sleeve encircling adjacent portions of the current collector and anode, and a means for uniformly applying a circumferential compression to the sleeve. The anode preferably has a cylindrical portion that is contiguously positioned next to and axially aligned with a cylindrical portion of the current collector. The current carrier provides the electrical connection between the anode and a current source.

Suitable materials for the metal sleeve are those which have sufficient conductivity and strength and are not reactive to the corrosive atmosphere within an electrochemical cell under operating conditions. Such materials include but are not limited to nickel, gold-plated nickel, NIGOLD plated nickel, platinum, palladium, iridium, rhenium, ruthenium, osmium, MONEL nickel alloy, copper, other copper-nickel alloys or other non-reactive metals or alloys. As used in this application, "non-reactive" means the materials are thermodynamically stable to fluorine or hydrogen fluoride vapor, or the materials form a passive coating on the surface, immediately upon contact with fluorine or hydrogen fluoride vapor. A means for applying the circumferential compression is the application of several compression bands. The bands can be typically fabricated from ordinary mild steel, that is, a carbon steel with a very low percentage of carbon (<0.25% carbon). Other materials that can be used as the compression means are corrosion resistant under conditions of cell operation and provide sufficient tensile strength to support the anode weight and to provide a compressive connection.

Alternatively, the current collector can be fabricated with an extension cuff that functions like the metal sleeve, has an outside diameter the same or nearly the same as that of the current collector and an inside diameter that is the same or slightly smaller than a cylindrical portion of the anode. The extension cuff further functions as the compression means. For example, the extension cuff can be heated to a temperature sufficient to expand the diameter of the cuff and the anode is then fitted into the expanded extension cuff. The fitted pieces are then cooled, causing the extension cuff to "shrink fit" around the cylindrical portion of the anode, providing a mechanical and electrical connection.

Advantageously, the compression means for applying circumferential compression provides metal-to-carbon connection that avoids the problem of uneven mechanical stress that promotes anode cracking. For example, a conventional technique of providing a metal-to-carbon joint is the insertion of a metal rod into the interior of a carbon electrode. This tends to put expansion stress on the electrode and to promote cracking. Mechanical failure of the electrode by cracking is due to uneven mechanical stress, that results in breaking the carbon at or near the metal-carbon joint.

An embodiment of the anode is one comprising a portion of nongraphitic carbon with a plurality of parallel, substantially vertical channels disposed on the surface of the carbon, such channels facilitating the flow of the generated fluorine and the collection thereof. Preferably, the nongraphitic carbon has a low permeability, that is, carbon with a density of typically greater than or equal to 1.4 $g.cm^{-3}$ and porosity that is typically less than or equal to 22%. Permeability of the carbon is typically 0.03 $m^2air.m^{-2}min$ (0.1 $ft^3air.ft^{-2}min$) through a 2.54 cm (1 inch) thick plate at $5.0\times10^2$ Pa (0° C. and at 760 mm Hg pressure). Electrical resistivity is typically 0.00414 ohms cm.

In an embodiment of the electrode of this invention, an anode is provided with a means for purging fluorine generated at the anode during an electrochemical cell operation. The purging means provides a means for flowing an inert gas (that is, "non-reactive" to fluorine during the electrochemical cell operation) into the anode at a point just above the electrolyte level. The enclosed space above the electrolyte level within the electrochemical cell is typically referred to as "headspace," where generated fluorine is collected and/or accumulated. The inert gas purges the fluorine out of the pores of the anode above the electrolyte surface rather than allowing the fluorine to flow upward along the upper length of the anode into the headspace. The purging means provides corrosion protection to the current carrier and the anode portion within the headspace of the electrochemical cell. The contacts of the sleeve and electrode are protected by purging the electrode or by causing the fluorine to flow out of the electrode above the electrolyte level. Advantageously, as the anode is purged, the generated fluorine is diluted with a inert purging gas. This provides an additional measure of protection against corrosion of the metal-carbon joint, as well as providing useable diluted fluorine gas (as will be described in connection with FIG. 7). Preferably, the density of the permeable carbon anode is typically about 1.0 $g.cm^{-2}$ and porosity is typically 45-50%. Permeability of the carbon ranges from 0.3 to 3 $m^3air.m^{-2}min$ (1.0 to 10 $ft^3air.ft^{-2}min$) through a 2.54 cm (1 inch) thick plate at $5.0\times10^2$ Pa (0° C. and 760 mm Hg pressure). Electrical resistivity is typically 0.0177 ohms cm.

Another aspect of the present invention provides an electrochemical cell for the electrolytic production of fluorine gas from molten KF.2HF electrolyte, said cell comprising a cell housing, a current carrier, a current collector, a first electrode used as a hydrogen-generating cathode and a second electrode used as a fluorine-generating anode, wherein the anode of the electrode comprises nongraphitic carbon. The electrochemical cell preferably comprises a cell housing that functions as a cathode, an electrode for use as an anode comprising the combination of (1) a current collector, (2) an anode, (3) a current carrier comprising (a) a metal sleeve overlaying a portion of the anode, and (b) a means for uniformly applying circumferential compression to the metal sleeve overlaying the anode, such that the metal sleeve provides an electrical connection between the current collector and the anode, and (4) a means for purging or diluting fluorine generated at the anodic surface.

Another aspect of the present invention provides a unified process of electrochemical generation of fluorine combined with direct fluorination of an organic substance. The process comprises generating in the electrochemical cell of the present invention a fluorine-inert gas mixture as a product. The product of the cell is then fed directly into a direct fluorination ("DF") reactor, such as is described in PCT WO 90/06296 (Costello et al.) to produce a fluorinated organic substance. Gaseous effluent products of the DF reactor may include some fluorinated product, inert gas, and hydrogen fluoride.

The DF reactor useful in the process of this invention can be equipped with a cooling jacket or internal cooling coils to control the temperature, a stirrer to vigorously agitate the reaction mixture as fluorine gas is bubbled through it, and if volatilized reaction medium and/or low boiling perfluorinated products are to be recovered, a reflux condenser. Generally, the reactor temperature will be maintained at a temperature in the range of about 0° C. to about +150° C., preferably about 0° C. to about 50° C., most preferably about 10° C. to 30° C., sufficient to volatilize the hydrogen fluoride by-product and with the aid of the flowing inert gas cause the purging of the by-product from the fluorination reactor as it is generated. The design and temperature of the condenser should be such as to minimize or prevent the hydrogen fluoride from returning to the reactor, for example, either by selective condensation of the inert liquid reaction medium or other organic substances, allowing the hydrogen fluoride to pass through the condenser, or by total condensation into a separate vessel of hydrogen fluoride, inert liquid reaction medium, or other organic substances followed by separation of the hydrogen fluoride as the upper liquid phase and, if desired, recycle of the lower liquid phase. The minimization or prevention of the return of hydrogen fluoride is of particular significance in the case of starting materials such as ethers or olefinic material, which are adversely affected by hydrogen fluoride, a low yield of the corresponding perfluoro product generally resulting if the hydrogen fluoride is retained in the reactor during fluorination. The inert carrier gas glow rate sufficient for effective removal of hydrogen fluoride varies according to reactor and condenser geometry. However, a rate of about 1300 mL/min of 20% fluorine in nitrogen in a reactor containing 2 liters of FREON 113° at 20° C. connected to a condenser consisting of about 6 meters of coiled 1,27 cm diameter stainless steel tubing at −25° C. gives high yields of perfluorinated ether product. Fluorine is preferably used at a concentration of about 5 to 50 volume %, more preferably about 10 to 25 volume %, in an inert gas such as, for example, nitrogen, argon, helium, $CF_4$, or $SF_6$, preferably nitrogen, and is maintained in stoichiometric excess throughout the fluorination, for example, at an excess of up to about 15 to 40% or higher. Pure fluorine can also be used but it is not preferred, due to considerations of both safety and economy.

The effluent products of the DF reactor may be separated by conventional means, such as decantation, or distillation, so that the fluorinated product of direct fluorination can be collected and used appropriately, while the inert gas can be recycled back to the electrochemical cell. Additionally, hydrogen fluoride separated from the product of the DF reactor can be recycled to the electrochemical cell to replenish the molten KF-2HF electrolyte.

BRIEF DESCRIPTION OF THE DRAWING

In the accompanying drawings:

FIG. 2 is a diagrammatic isometric view in elevation of a sleeve in accordance with the invention;

FIG. 3 is a diagrammatic planar view of a sleeve configuration;

DESCRIPTION OF THE PREFERRED EMBODIMENT(S)

Figure 1:
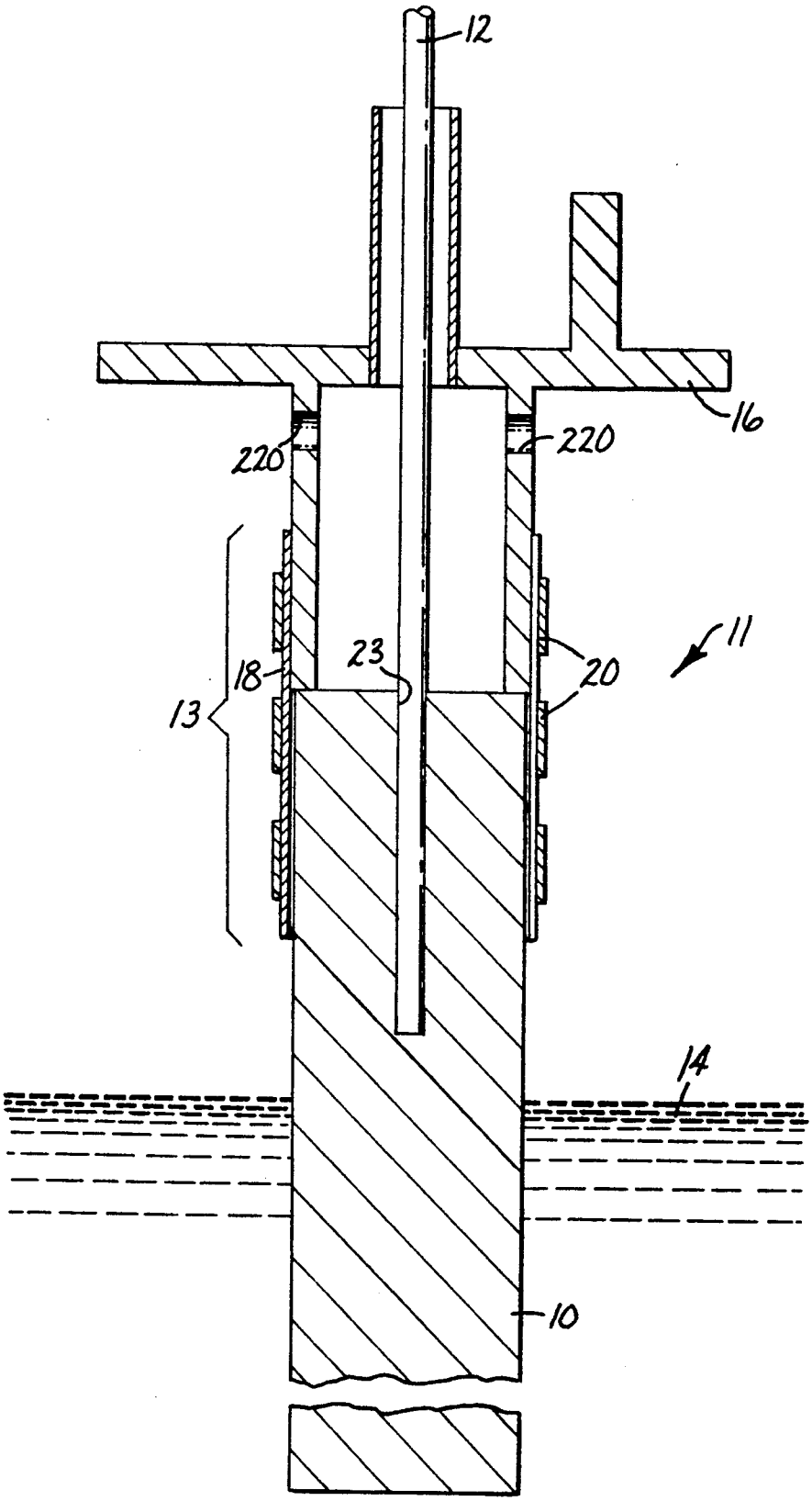
FIG. 1 is a diagrammatic cross-sectional view in elevation of a one embodiment of an electrode of the invention.
Figure 4:
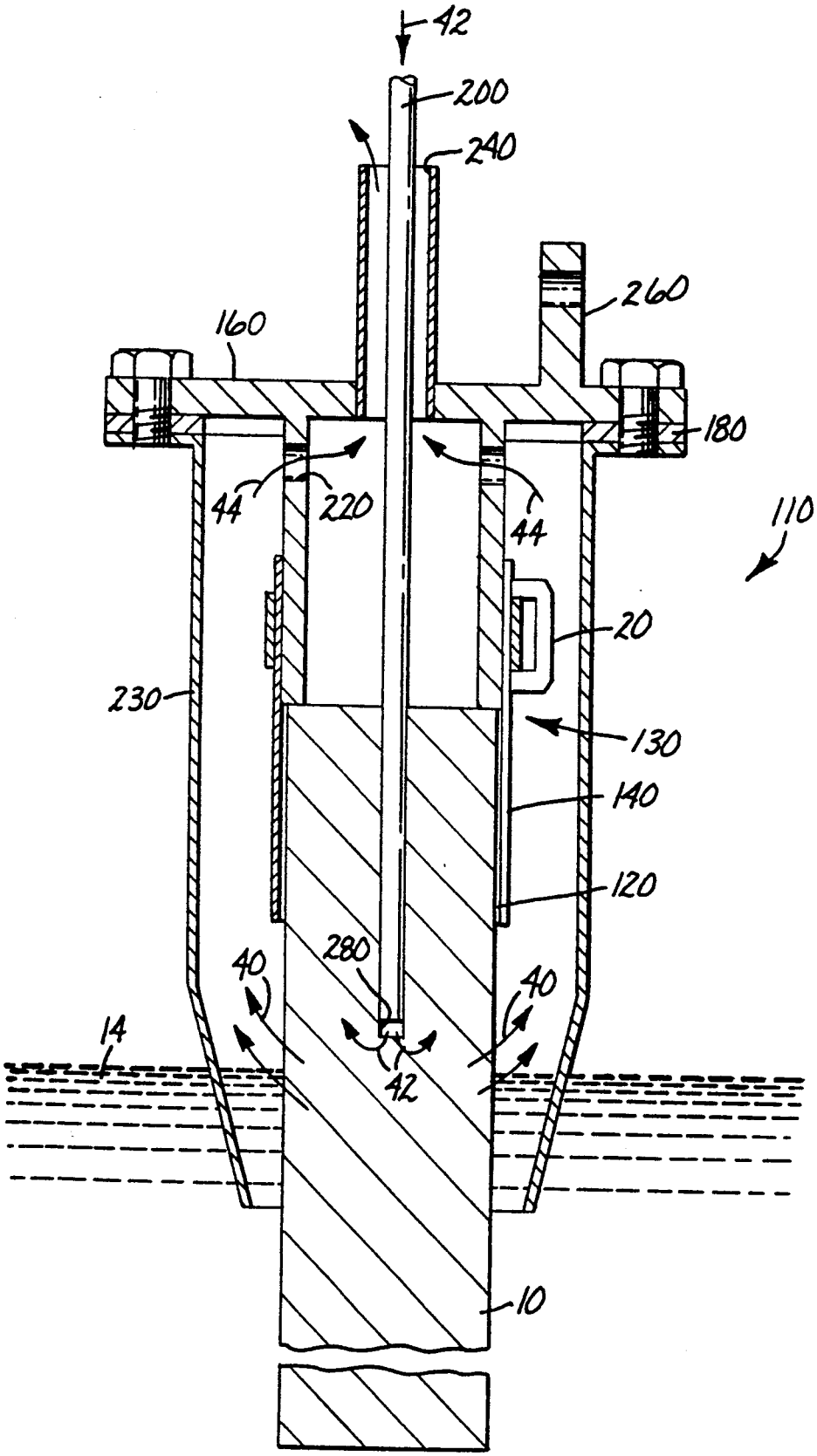
FIG. 4 is a diagrammatic cross-sectional view in elevation of a the electrode configuration of FIG. 1 shown with a skirt and a purging means.

Referring now to the drawings, wherein like reference numbers have been employed to denote like elements, and initially to FIGS. 1 and 4, is illustrated an electrode assembly designated generally by reference number 11, which comprises a cylindrical, non-graphitic anode 10 surmounted by a contiguous current collector 16. Anode 10 and current collector 16 are encircled by an anode current carrier designated generally by reference number 13 comprising a metal sleeve 18 (see FIGS. 2 and 3) and a compression means 20. Anode 10, current collector 16 and metal sleeve 18 are circumferentially compressed together by compression means 20. When electrode 11 is positioned in an electrolytic cell (see FIG. 6) containing an electrolyte solution, the approximate upper level of the electrolyte in the cell is illustrated with reference number 14. The upper portion of the electrode 11 in the headspace (illustrated in FIG. 6), that is, the area above upper level of electrolyte 14, is susceptible to resistive heating and attack by generated fluorine and other vapors present in the headspace during normal cell operating conditions. An optional anode probe 12 descending through an opening in the center of current collector 16 into anode 10 is a sheathed thermocouple that measures the temperature and voltage in anode 10, terminating just above the electrolyte upper level 14. Typically, a small hole 23 is drilled into the geometric center of anode 10. Additionally, several openings 220 are illustrated.

Anode 10, having an upper cylindrical portion, can be a low-permeability or high-permeability monolithic structure, or of a composite structure. In the composite structure, there is an inner core of low-permeability carbon and an outer shell of high-permeability carbon formed onto the low-permeability part, as described in UK Patent Application 2 135 335 A.

Current collector 16 is typically fabricated from ordinary mild steel, nickel, MONEL nickel alloy, or other suitable materials. Current collector 16 serves to conduct current to the anode 10, mechanically supports anode 10, and can function as a conduit for collection of the generated fluorine (see also FIG. 4, current collector 160).

Metal sleeve 18 provides mechanical and electrical continuity between current collector 16 and anode 10. Alternatively, the current collector 16 can be provided with an extension cuff as an integral part of the current collector 16 and functions as metal sleeve 18.

Referring now to FIG. 2, a preferred embodiment of metal sleeve 18 is shown can typically be fabricated from nickel-plated copper, although nickel, Monel TM nickel alloy, or other corrosion resistant alloys, overplated with gold-plate or other non-reactive metals may be used as well. The plating comprises a layer of nickel electroplated directly onto a copper sheet, followed by a layer of gold electroplated onto the nickel layer. The copper should be thick enough to carry current of 3 or 4 amps up to several thousand amps, and flexible enough to provide a compressive connection, yet be strong enough to support anode 10 during handling and set-up of the electrochemical cell. Nickel can be electroplated onto the copper until a layer thickness in the range of 1 to 100 micrometers is attained. The gold electroplate is typically thinner than the nickel plating and is should be sufficiently thick enough to provide a protective, non-reactive, conductive layer. The gold plating thickness is typically in the range of 0.1 to 100 micrometers. The length and diameter of metal sleeve 18 is determined by the diameter of current collector 16 and anode 10. The contact area between split sleeve 18 and anode 10 should be sufficient to ensure electrical continuity and mechanical stability.

Optionally, anode 10 may be coated with a sprayed-on nickel layer to provide an improved electrical connection between current collector 16 and anode 10. The sprayed-on nickel layer is typically applied prior to assembly of anode 10 and current carrier 16 by means of anode current carrier 13. The sprayed-on nickel coating can be provided by processes known to those skilled in the art, such as, plasma spraying, electrolytic, or electroless deposition.

Referring to FIG. 3, an alternative embodiment of metal sleeve 18 as shown in FIGS. 1 and 2, is a metal sleeve 22 comprising a metal plate 24 with shims 26. Metal plate 24 may be copper, nickel-plated copper, nickel, MONEL nickel alloy, gold-plated copper, or any combination thereof. The number of shims 26 is dependent on the relative sizes of sleeve 22 and shims 26. Shims 26 are inserted in a variety of ways. A simple method is to assemble anode 10 (shown in FIG. 1) and current collector 16 (shown in FIG. 1), loosely positioning metal sleeve 32 around anode 10 and current collector 16. Shims 26 are then positioned under metal plate 24 (as shown in FIG. 3) and sleeve 22 tightly clamped into position with several bands 20 (shown in FIG. 1). Shims 26 may be fabricated from nickel-plated copper, copper, nickel, gold-plated nickel or gold-plated copper or other non-reactive metals, such as platinum, palladium. Shims 26 are preferably fabricated from NI-GOLD gold-plated nickel strips. Shims 26 typically have at least 1 micrometer of gold plating. NiGold TM gold-plated nickel, a proprietary product (available from Inco Alloys International, Inc., Huntington, W. Va.) is a strip of metal alloy that is thermally treated to produce a controlled surface.

A commercially available compression means 20 (as shown in FIGS. 1 and 4) is several mild steel bands (for example, available from Fast Lok, Decorah, Ioawa). Several compression means 20 hold anode 10 contiguously positioned next to current collector 16 by compression. Compression means 20 are typically positioned closer together than illustrated in FIGS. 1 and 4. The separation of the compression means 20 as illustrated in the Figures is for clarity rather than for accuracy.

Referring to FIG. 4, there is illustrated a portion of an electrode, designated generally by the reference number 110, which comprises a cylindrical, nongraphitic portion of an anode 10 (anode) contiguous to a current collector 160. Anode 10 and current collector 16 are encircled by an anode current carrier designated generally by the reference number 130 comprising a split metal sleeve 140, with metal shims 120 and several compression means 20 (only one is illustrated for simplicity). Tubing 200 is inserted into an opening 240 positioned at or near the geometric center of current collector 16 and anode 10. The bottom of tubing 200 is positioned such that a small empty space 280 remains at the bottom of opening 240. Tubing 200 is typically nickel, copper, MONEL nickel alloy, or other non-reactive metal, that is, non-reactive to fluorine generated at anode 10. During operation of the electrolytic cell (see FIG. 6, non-reactive gas, generally designated by arrow 42 flows through tubing 200 and to the bottom of tubing 200, through anode 10 just above electrolyte level 14 into the headspace. During fluorine generation, non-reactive gas 42 and generated fluorine 40, flows as designated by arrows, generally designated as effluent product flows, as designated by arrow 44 through openings 220 in current collector 16 and through opening 240. Non-reactive gases suitable for the practice of this invention include but are not limited to nitrogen, argon, krypton, xenon, $SF_6$, and $CF_4$.

Effluent product 44 can be separated using conventional separation techniques, such as, distillation to provide essentially pure fluorine and the non-reactive gas used in the purging means. Effluent product 44 can be used in a direct fluorination reaction as described in PCT WO 90/06296 (Costello et al.), see also FIG. 7 and the description thereof, as the atmospheric gas for various film processing techniques, such as described in *Surface Treatment of Polymers, II. Effectiveness of Fluorination as a Surface Treatment for Polyethylene*, J. Appl. Polym. Sci. vol. 12, pp 1231–37 (1968) and U.S. Pat. No. 4,491,653, in the production of uranium hexafluoride and cobalt trifluoride or wherever fluorine diluted with a non-reactive gas mixture may be used.

A skirt 230 separates the product hydrogen, which is generated at the cathode (not shown) from product fluorine, which is generated at the anode 10. Skirt 230 is not electrically connected to either anode 10 or the cathode, except by means of the electrolyte 14. Skirt 230 is electrically separated from current collector 16 by a gasket 180. Skirt 230 is typically fabricated from MONEL nickel alloy, magnesium, manganese, or ordinary mild steel, nickel or other suitable materials that are non-reactive to fluorine. Electrical connection to anode 100 is via a bus bar (not shown) to a bus connector 260, through current collector 16, and anode current carrier 130. Although FIG. 4 illustrates a metal sleeve configuration similar to the one illustrated in FIG. 3, metal sleeve 18 as illustrated in FIG. 2 or the extension cuff described supra may also be used.

Figure 5A:
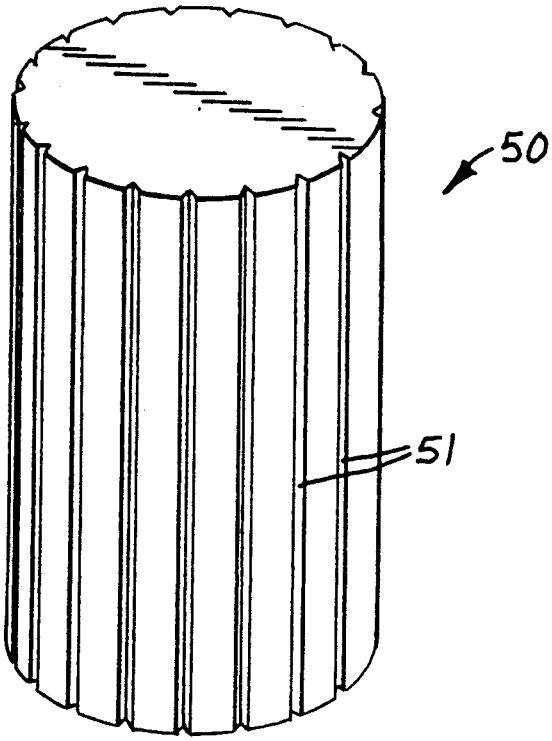
FIGS. 5*a* and 5*b* are isometric views of two embodiments of an anode, each having a plurality of channels on the anodic surface.
Figure 5B:
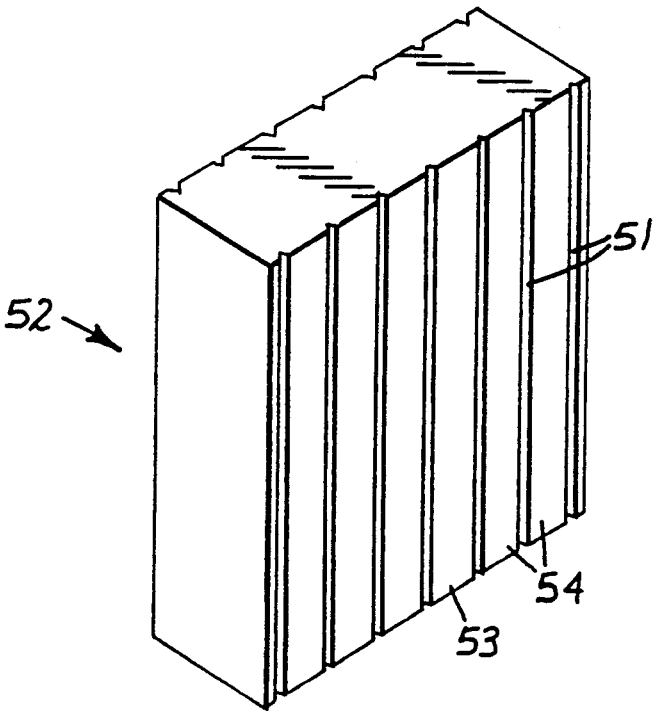

Referring to FIG. 5*a*, an anode 50 is shown comprising a portion of low-permeability nongraphitic carbon, with a plurality of parallel, substantially vertical channels 51 disposed around the circumference of anode 50. Channels 51 should be sufficiently deep to permit the generated fluorine gas to move upwards within channels 51. If channels 51 are too narrow, there is too small a means for the flow of the gas up anode 50. If channels 51 are too wide, the electrolyte will flood channels 51. Having a channel too wide is significantly less of a problem than having a channel too narrow. If the channel is too wide, only a minor amount of energy is required to push the electrolyte out of the channel. Channels 51 can be V-shaped, U-shaped, rectangular-shaped, elliptical-shaped or any regular geometric shape and the surfaces within channels 51 may be optionally smooth and polished. Channels 51 are approximately in the range of 10 to 1000 micrometers (μm) wide by 100 to 5000 μm deep, and of sufficient length to facilitate the flow of the generated fluorine. Preferably, channels 51 extend from a point just below the current carrier to the bottom of anode 50. Channels 51 are positioned around a cylindrical body or vertically disposed on a carbon slab at a distance between channels 51 that is approximately 3 to 50 times the width of channel 51. Channels 51 facilitate the flow of the generated fluorine and the collection thereof, where the generated fluorine could otherwise block current. When the carbon anode is configured as shown in FIG. 5*a* and approximately cylindrical, channels 51 are vertically disposed around the circumference of anode 50. When the carbon anode is configured as shown in FIG. 5*b* and approximately planar, channels 51 are vertically disposed across electrolytically active portion 53 of anode 52. Optionally, surface 54 between channels 51 is smooth and polished. Processes for polishing of surface 54 between channels 51 are well known and include the process as described U.S. Pat. No. 4,602,985 (Hough).

Optionally, the carbon anode (of either configuration) may be fabricated from high-permeability, nongraphitic carbon or be a composite structure as described in UK Patent Application 2 135 335A. Furthermore, the carbon anode may include transition metals, such as nickel, dispersed therein. See U.S. Pat. No. 4,915,809.

Figure 6:
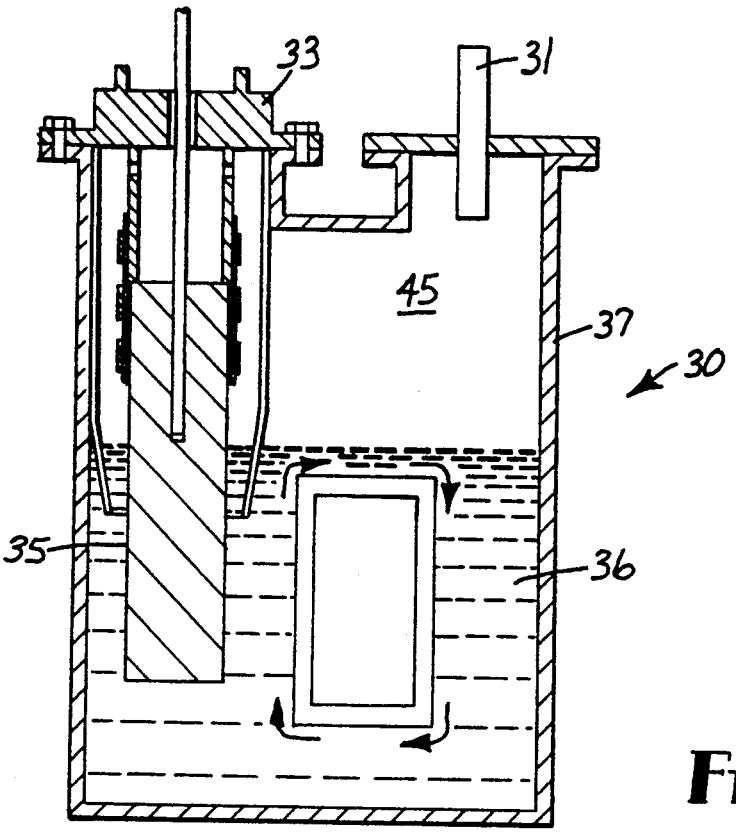
FIG. 6 is a diagrammatic representation in elevation of an electrochemical cell of this invention.

Referring to FIG. 6, an improved electrochemical cell 30 for the production of fluorine gas in a molten KF.2HF electrolyte is illustrated. Electrochemical cell 30 comprises a container or housing 37 for containing an electrolyte 36 and is comprised of walls inert to electrolyte 36, and electrode 35 connected to a source of direct current (not shown). Container 37 is also connected to a source of direct current (not shown). Electrode 35 may be positioned in container 37 for immersion into the electrolyte 36, such that when current is applied to current carrier 33, electrode 35 is made electrochemically anodic and when current is applied to container 37, container 37 is made electrochemically cathodic. A means 31 for collecting gases evolved from the cathode (hydrogen gas) and a means for controlling and limiting the working temperature (not shown) of electrolyte 36 are also provided. Also depicted is headspace 45, which has previously been defined.

The electrochemical cell of the present invention utilizes as electrode one of the three alternative above-described embodiments of the electrode of the present invention, as described in reference to FIGS. 1, 4 and 5. The preferred electrode is electrode 110 (see FIG. 4), comprising an anode 10, an anode current carrier 13 and a purging means. Electrochemical cell 30 may be operated according to the processes described, for example, in Organic Electrochemistry, An Introduction and a Guide, (3rd ed.), *Anodic Fluorination*, Chap 26, pp 1103–27, (Marcel Dekker, Inc., 1991) and Techniques of Chemistry, "Technique of Electroorganic Synthesis," *The Phillips Electrochemical Fluorination Process*, Chap 7, pp 341–84, (John Wiley & Sons, 1982).

Figure 7:
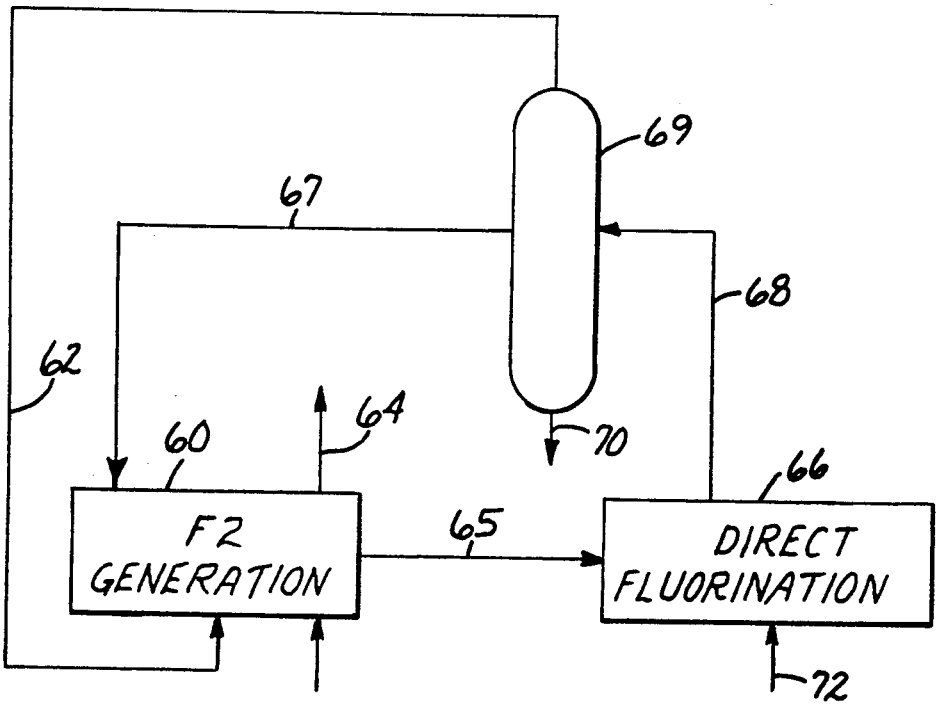
FIG. 7 is a schematic diagram of a unified process of fluorine generation and direct fluorination of the present invention.

Referring to FIG. 7, a schematic representation of a unified process of fluorine generation and direction fluorination is illustrated. A preferred unified process comprises the steps of:

(1) generating fluorine in an electrochemical cell 60 from potassium fluoride hydrogen fluoride electrolyte (not shown) and having a purging means (not shown);

(2) introducing a non-reactive gas 62 into electrochemical cell 60, such that the generated fluorine is purged from the anode (not shown) of electrochemical cell 60;

(3) removing gaseous mixture 65 from electrochemical cell 60;

(4) removing gaseous hydrogen 64 from electrochemical cell 60 generated at the cathode, and discarding;

(5) feeding gaseous mixture 65 into direct fluorination reactor 66 of a type similar to the reactor described in PCT WO 90/06296 (Costello et al.);

(6) feeding an organic hydrocarbon precursor 72 into direct fluorination reactor 66, such that organic hydrocarbon precursor 72 and gaseous mixture 66 are reacted together to produce reactor products 68 comprising of fluorinated products 70, hydrogen fluoride 67, inert gas 62, and unreacted fluorine;

(7) collecting reactor products 68 in a collection means 69, wherein collection means 69 may provide a means to separate reactor products 68 into fluorinated products 70, hydrogen fluoride 67, inert gas 62, and unreacted fluorine;

(8) optionally recycling non-reactive gas 62 into electrochemical cell 60, as described in step (2); and (9) optionally recycling hydrogen fluoride 67, to electrochemical cell 60, wherein the recycled hydrogen fluoride 67, replenishes hydrogen fluoride depleted from the potassium fluoride hydrogen fluoride electrolyte (not shown); and

(10) optionally, recycling fluorine.

Objects and advantages of this invention are further illustrated by the following examples, but the particular materials and amounts thereof recited in these examples, as well as other conditions and details, should not be construed to unduly limit this invention. In the following examples, the molten electrolyte contained 20.85 meq of HF per gram electrolyte (41.7 wt % of HF), nominally described as KF.2HF.

EXAMPLE 1

This is an example of an electrochemical cell run using an electrode with a nickel-plated sleeve without gold plating, as illustrated in FIG. 1. A standard laboratory cell was used, as described in Rudge et al. supra. The cathode was a mild steel cell container. The cell case was jacketed for temperature control. The anode portion of the electrode was a commercially available high-permeability, non-graphitic carbon (Type PC-25, available from Union Carbide). The carbon anode piece was approximately 35.6 cm long, with an outer diameter (O.D.) of 3.5 cm. The metal sleeve was approximately 25 cm long, 3.5 cm in diameter and 0.32 cm thick nickel-plated copper. When assembled, the electrode was immersed to a depth of approximately 26.4 cm in KF.2HF electrolyte. The cell was operated at approximately 90° C. The cell was started up by ramping to 59.6 amperes. As fluorine was generated, it was reacted with ethane. The ethane was fed into the cell at a rate sufficient to ensure an excess of ethane. Hydrogen fluoride (HF) was fed into the cell on demand to replenish the electrolyte depleted of HF as fluorine is generated. The run was halted after 54 hours due to the corrosion of the metal-carbon joint located in the cell headspace. The headspace was filled with a gas mixture comprising unreacted fluorine, HF, potassium fluoride, and unreacted ethane. At 59.6 amperes after 1400 ampere hours, the voltage drop between the current collection and the high-permeability carbon was 45 millivolts (mV) and was increasing.

EXAMPLE 2

This is an example of an electrochemical cell run using an electrode with a nickel-plated copper sleeve plated with gold, as illustrated in FIG. 1. A standard laboratory cell was used, as described in Example 1 and Rudge et al., supra. The cathode was a mild steel cell container. The cell case was jacketed for temperature control. The anode was a commercially available high-permeability, nongraphitic carbon (Model PC-25, available from Union Carbide). The carbon anode piece was approximately 35.6 cm long, with an O.D. of 3.5 cm. The metal sleeve was approximately 25 cm long, 3.5 cm in diameter and 0.32 cm thick copper-plated with nickel and 1.3 micrometers of gold. When assembled, the electrode was immersed to a depth of approximately 26.4 cm in KF.2HF electrolyte. The cell was operated at 90° C. The cell was started up by ramping to 59.6 amperes. As fluorine was generated, it was reacted with ethane. The ethane was feed into the cell at a rate sufficient to ensure an excess of ethane. Hydrogen fluoride (HF) was fed into the cell on demand to replenish the electrolyte depleted of HF as fluorine is generated. The electrode was run for several hundred hours. At 59.6 amperes after 8000 ampere hours, the voltage drop was only 7.7 mV and there was no indication of increasing resistance, which would indicate corrosion to the metal-carbon joint.

EXAMPLE 3

This is an example of a run using an anode with a sleeve plated with NIGOLD plated copper, as illustrated in FIG. 1. Cell conditions and run operating conditions were similar to those of Examples 1 and 2, except the carbon anode was approximately 100 cm long, with an O.D. of 20 cm. When assembled, the electrode was immersed to a depth of approximately 80 cm in KF.2HF electrolyte. The cell was operated at 90° C. The anode was started up by ramping to 720 amperes. As fluorine was generated, it was reacted with ethane. The ethane was feed into the cell at a rate sufficient to ensure an excess of ethane. Hydrogen fluoride (HF) was fed into the cell on demand to replenish the electrolyte depleted of HF as fluorine is generated. The voltage drop across the metal-carbon joint, after 900 hours was stable at 330 to 350 mV at 720 amperes with no indication of an increasing resistance, which would indicate corrosion of the metal-carbon joint. Upon visual inspection at the end of the run, there was evidence of slight degradation.

EXAMPLE 4

This is an example of a run using a channeled, low-permeability carbon anode, as illustrated in FIG. 5(*a*).

A cylindrical, low-permeability carbon anode (Grade 6231, available from Stackpole Carbon Co., St. Marys, Pa.) was run in a fluorine cell. The carbon anode was 33.0 cm long, had an O.D. of 3.5 cm. When assembled, the electrode was immersed to a depth of 26.4 cm in KF.2HF electrolyte. The anode had vertical channels disposed around the circumference of the anode. The channels were 0.3 mm wide, 2 mm deep, and spaced at approximately 2 mm intervals, center to center. The cathode was a cylinder of MONEL nickel alloy with a 7.6 cm inside diameter (I.D.) surrounding the anode. The KF.2HF electrolyte was maintained at 90° C. During cell operation, hydrogen fluoride (HF) was continually added to replenish the electrolyte as fluorine and hydrogen were produced.

The anode was started up slowly by ramping up to 53.6 amperes (180 ma $cm^{-2}$) over a period of 9 days. On reaching a current reading of 53.6 amperes, the cell potential was 8.1 volts. The potential rose quickly and in 46 hours the anode polarized. The anode was depolarized by holding it at 24 volts for approximately 30 seconds. The voltage was then turned off, and back on again to restart the cell. A steady current of 53.6 amperes (180 ma $cm^{-2}$) was immediately established. The cell and anode were then run for more than an additional 1000 hours without polarizing again.

COMPARATIVE EXAMPLE C1

This is a comparative example using a solid low-permeability carbon anode without channels.

A cylindrical, solid carbon anode (Grade 6231, available from Stackpole Carbon Co., St. Marys, Pa.) was run in a fluorine cell. The carbon anode was 33.0 cm long, 3.5 cm O.D. and when assembled, the electrode was immersed to a depth of 26.4 cm in KF.2HF electrolyte. The anode had no channels. The cathode was a cylinder of MONEL nickel alloy with a 7.6 cm I.D. surrounding the anode. The KF.2HF electrolyte was maintained at 90° C. During the cell operation, HF was added to replenish the electrolyte as fluorine and hydrogen were produced.

The anode was first started up at 5 amperes (17 ma $cm^{-2}$). After only 1.3 hours at 5 amperes, the anode polarized. The anode was depolarized by holding it at 24 volts for approximately 30 seconds. The current was turned off, and back on again to restart the cell. Over a period of 24 hours, the current was ramped from 5 amperes to 53.6 amperes. Then after running only 139 hours at 53.6 amperes, the anode polarized again.

EXAMPLE 5

A high-permeability carbon anode (PC-25, available from Union Carbide) was used in the anode assembly as shown in FIG. 4 with a nitrogen purge tubing 200. A thermocouple (not shown) was inserted through tubing 200 to near the bottom of tubing 200. Nitrogen, flowing at approximately 1000 ml/min was metered into the carbon anode approximately at the electrolyte level through tubing 200. Nitrogen was not added to the bottom of the anode through a feed tube.

The anode ran well for over 350 hours at 53.6 amperes (200 ma $cm^{-2}$). The current level was then increased to 80 amperes. After approximately 4 hours of cell operation the terminal voltage appeared to be stable. The cell was shut down and the anode assembly was inspected. It was clear that the anode had suffered no damage. The carbon portion at the top of the electrode was sound and there was no sign of burning. Burning is usually evidenced by the presence of white material.

COMPARATIVE EXAMPLE C2

A high-permeability carbon anode (PC-25, available from Union Carbide) was used in the anode assembly as shown in FIG. 4, without the nitrogen purge line 200. Nitrogen, flowing at approximately 100 ml/min was metered into the bottom of the anode through a feed tube.

This anode ran for over 500 hours at 53.6 amperes (200 ma $cm^{-2}$). The current level was then increased to 80 amperes. After approximately 30 minutes of cell operation, the terminal voltage increased. Damage to the anode was suspected. The cell was shut down and the anode assembly was inspected. There was clear evidence that the anode had burnt just below the nickel sleeve. The damage was severe enough, that the anode broke at it was being removed from the cell.

Various modifications and alterations of this invention will become apparent to those skilled in the art without departing from the scope and spirit of this invention, and it should be understood that this invention is not to be unduly limited to this illustrative embodiments set forth hereinabove.

We claim:

1. An electrode for use in an electrochemical cell for the electrolytic production of fluorine gas from molten KF-2HF electrolyte said electrode comprising:

(1) a current collector, said current collector having a hollow portion;

(2) an anode comprising a cylindrical nongraphitic carbon portion; and (3) a current carrier comprising:

(a) a metal sleeve overlaying a portion of said anode and said hollow portion of said current collector, where the upper end of the anode and the lower end of the collector are axially aligned and abutted; and (b) a means for uniformly applying circumferential compression to said metal sleeve overlaying the contiguous and axially aligned and abutted portions of said anode and said current collector of the electrochemical cell to provide mechanical support for said anode and to provide electrical continuity between said anode and said current collector.

2. The electrode according to claim 1 wherein said metal sleeve is selected from the group consisting of copper, nickel, nickel-plated copper, gold-plated copper, and gold-plated nickel.

3. The electrode according to claim 2 wherein said nongraphitic carbon is either a low-permeability carbon or a high-permeability carbon.

4. An electrode for use in an electrochemical cell for the electrolytic production of fluorine gas from molten KF -2HF electrolyte said electrode comprising:

(1) a current collector, said current collector having a hollow portion;

(2) a continuously vertical nongraphitic, low-permeability carbon anode consisting of a plurality of parallel channels, disposed vertically around the outer surface of said anode, and;

(3) an anode current carrier comprising:

(a) a metal sleeve overlaying a portion of said anode and said hollow portion of said current collector, where the upper end of the anode and the lower end of the collector are axially aligned and abutted; and (b) a means for uniformly applying circumferential compression to said metal sleeve overlaying the contiguous and axially aligned and abutted portions of said anode and said current collector of the electrochemical cell to provide mechanical support for said anode and to provide electrical continuity between said anode and said current collector.

5. An electrode for use in an electrochemical cell for the electrolytic production of fluorine gas from potassium fluoride hydrogen fluoride molten electrolyte, comprising a current collector and an anode, wherein said electrode comprises:

(1) a nongraphitic, low-permeability carbon portion;

(2) an anode current carrier comprising:

(a) a metal sleeve overlaying a portion of said anode and said hollow portion of said current collector, where the upper end of the anode and the lower end of the collector are axially aligned and abutted; and (b) a means for uniformly applying circumferential compression to said metal sleeve overlaying the contiguous and axially aligned and abutted portions of said anode and said current collector of the electrochemical cell to provide mechanical support for said anode and to provide electrical continuity between said anode and said current collector said nongraphitic carbon portion of said anode and said current collector having approximately the same outer diameter, when said electrode is used in an electrochemical cell said current carrier and said portions of said anode and said current collector overlaid by said current carrier are wholly contained within said electrochemical cell; and (3) a means for purging fluorine generated at said anode and dispersed in the pores of said anode with metered, downward flowing gas that is inert to said fluorine, said means for purging fluorine has both ends of said means above the electrolyte upper surface when said electrode is positioned in said electrochemical cell.

6. An electrochemical cell for the electrolytic production of fluorine gas from molten KF -2HF electrolyte comprising:

(1) a cell housing;

(2) a current collector, said current collector having a hollow portion;

(3) a first electrode used as a hydrogen generating cathode;

(4) a second electrode used as a fluorine generating anode, wherein said anode of said electrode is comprised of a continuously vertical nongraphitic low-permeability carbon, wherein the surface of the anode consists of a plurality of parallel, substantially vertical channels disposed around the circumference of said anode, and;

(5) an anode current carrier comprising:

(a) a metal sleeve overlaying a portion of said anode and said hollow portion of said current collector, where the upper end of the anode and the lower end of the collector are axially aligned and abutted; and (b) a means for uniformly applying circumferential compression to said metal sleeve overlaying the contiguous and axially aligned and abutted portions of said anode and said current collector of the electrochemical cell to provide mechanical support for said anode and to provide electrical continuity between said anode and said current collector with the proviso that said portions of said anode and said current collector have approximately the same outer diameter, said current carrier and said portions of said anode and said current collector overlaid by said current carrier are wholly contained within said cell housing.

7. The electrochemical cell according to claim 6 wherein said cell housing is used as said first electrode.

8. An electrochemical cell for the electrolytic production of fluorine gas from molten KF -2HF electrolyte comprising:

(1) a cell housing;

(2) a current collector, said current collector having a hollow portions;

(3) a first electrode used as a hydrogen generating cathode;

(4) a second electrode used as a fluorine generating anode, wherein said anode of said electrode is comprised of nongraphitic low-permeability carbon;

(5) an anode current carrier comprising:

(a) a metal sleeve overlaying a portion of said anode and said hollow portion of said current collector, where the upper end of the anode and the lower end of the collector are axially aligned and abutted; and (b) a means for uniformly applying circumferential compression to said metal sleeve overlaying the contiguous and axially aligned and abutted portions of said anode and said current collector of the electrochemical cell to provide mechanical support for said anode and to provide electrical continuity between said anode and said current collector with the proviso that said portions of said anode and said current collector have approximately the same outer diameter, said current carrier and said portions of said anode and said current collector overlaid by said current carrier are wholly contained within said cell housing; and (6) a means for purging fluorine generated at said anode and dispersed in the pores of said anode with metered, downward flowing gas that is unreactive to said fluorine, said means for purging fluorine has both ends of said means above the electrolyte upper surface when said electrode is positioned in said electrochemical cell.

* * * * *